US009731338B2

(12) United States Patent
Guzzo

(10) Patent No.: US 9,731,338 B2
(45) Date of Patent: Aug. 15, 2017

(54) WIRE BEND FIXTURE

(71) Applicant: AFL Telecommunications LLC

(72) Inventor: Lou Guzzo, Inman, SC (US)

(73) Assignee: AFL Telecommunications LLC, Duncan, SC (US)

( * ) Notice: Subject to any disclaimer, the term of this patent is extended or adjusted under 35 U.S.C. 154(b) by 288 days.

(21) Appl. No.: 14/410,668

(22) PCT Filed: Jun. 26, 2013

(86) PCT No.: PCT/US2013/047819
§ 371 (c)(1),
(2) Date: Dec. 23, 2014

(87) PCT Pub. No.: WO2014/004624
PCT Pub. Date: Jan. 3, 2014

(65) Prior Publication Data

US 2015/0367401 A1 Dec. 24, 2015

Related U.S. Application Data

(60) Provisional application No. 61/664,347, filed on Jun. 26, 2012.

(51) Int. Cl.
*B21F 1/00* (2006.01)

(52) U.S. Cl.
CPC ..... *B21F 1/004* (2013.01)

(58) Field of Classification Search
CPC ... B21F 1/004; B21F 1/06; B21D 7/02; B21D 7/022
USPC ..... 140/102, 102.5, 104
See application file for complete search history.

(56) References Cited

U.S. PATENT DOCUMENTS

| | | | | | |
|---|---|---|---|---|---|
| 880,235 | A | | 2/1908 | Neller | |
| 1,316,257 | A | * | 9/1919 | Snell | B21F 1/06 140/104 |
| 2,430,899 | A | * | 11/1947 | Wallace | B21D 7/022 72/388 |
| 2,456,532 | A | * | 12/1948 | Perazzo | B21D 7/022 140/102.5 |
| 2,675,723 | A | | 2/1951 | Stein | |
| 2,857,792 | A | * | 10/1958 | McNish | B21F 1/06 140/123 |

(Continued)

OTHER PUBLICATIONS

International Search Report for PCT/US2013/047819 dated Nov. 26, 2013.

*Primary Examiner* — Teresa M Ekiert
(74) *Attorney, Agent, or Firm* — Dority & Manning, P.A.

(57) ABSTRACT

A wire bending apparatus and a method for bending a wire and creating a loop in the wire is provided. The wire bending apparatus includes an anvil block that is connectable to a wire bending portion and connectable to a loop bending portion, such that the wire bending portion and the loop bending portion are rotatable. The anvil block includes a gap for holding a wire and the wire bending portion includes a groove for positioning the wire to be parallel to the direction of the wire when the wire bending portion is connected to the anvil block and rotated to form the bend in the wire. The loop bending portion includes a channel for engaging the wire when the loop bending portion is connected to the anvil block and rotated to form a loop in the wire.

22 Claims, 14 Drawing Sheets

(56) References Cited

U.S. PATENT DOCUMENTS

| | | | | | |
|---|---|---|---|---|---|
| 3,374,808 | A | * | 3/1968 | Schroeder | B21F 1/06 140/102 |
| 3,538,737 | A | * | 11/1970 | Del Monica | B21D 7/022 72/31.05 |
| 3,585,662 | A | * | 6/1971 | Boyajian | B21D 11/12 30/194 |
| 5,901,600 | A | | 5/1999 | Decker | |
| 7,814,817 | B1 | | 10/2010 | Sheriff | |
| 2011/0041583 | A1 | | 2/2011 | Sheriff | |

* cited by examiner

WIRE BEND FIXTURE

CROSS-REFERENCE TO RELATED APPLICATIONS

This application is based upon and claims the benefit of priority from U.S. Provisional Application No. 61/664,347, filed Jun. 26, 2012, in the United States Patent and Trademark Office, the disclosures of which are incorporated herein in its entirety by reference.

BACKGROUND

1. Field

The invention is related to wire bending apparatus and method, and more particularly, to a wire bending apparatus and method for bending a wire and forming a closed loop.

2. Related Art and Background

Many hand tools and methods exist to form a loop in a section of straight wire. However, the conventional hand tools do not form a closed (or nearly closed loop) is a section of straight wire so that the wire can be easily installed to a terminal or other mounting blocking using a fastener.

It is an object of the invention to provide efficient solutions for creating loops in wires of terminal block attachment.

It is also an object of the invention to provide an apparatus to form a sharp bend (80 to 100 degree bend) and form a closed loop in a short length of wire. This invention allows for the intentional grounding of a wire strand in a cone-wedge termination used in a dead-end or a subsea termination. This invention can also be applied more generally in other areas for bending wires and creating loops in wires.

SUMMARY

Exemplary implementations of the present invention address at least the above problems and/or disadvantages and other disadvantages not described above. Also, the present invention is not required to overcome the disadvantages described above, and an exemplary implementation of the present invention may not overcome an of the problems discussed above.

According to an embodiment of the invention, there is provided a wire bending apparatus including a base portion having a gap perpendicular to the length direction of the base portion for anchoring a wire, a wire bending portion connectable to the base portion for bending the wire and a loop bending portion connectable to the base portion for creating a loop on the bent portion of the wire.

In an embodiment, the base portion includes a first connecting part, a second connecting part and a securing portion that secures the wire to the gap of the base portion.

In an embodiment, the wire bending portion includes a groove provided along a length direction of the wire bending portion, in which the wire is positioned such that the wire is parallel to the wire bending portion, and a third connecting part connectable to the first connecting part. In an embodiment, the loop bending portion includes a fourth connecting part connectable to the second connecting part, wherein the wire is rotatable around the fourth connecting part to create the loop on the bent portion of the wire.

According to another embodiment, there is provided a wire bending method that includes installing a wire in a base portion of the wire bending apparatus, connecting a wire bending portion to the base portion and positioning the wire bending portion to be parallel to the direction of the wire installed in the base portion, pivoting the wire bending portion downwards towards the base portion, disconnecting and removing the wire bending portion from the base portion, connecting a loop bending portion to the anvil block and engaging the wire in a channel in the loop bending portion and rotating the loop bending portion to form a loop in the wire.

In an embodiment, the wire bending portion is connected to the base portion via a dowel pin placed into holes in the wire bending portion and the base portion.

In an embodiment, the wire is installed in a gap perpendicular to the length direction of the base portion.

In an embodiment, the thickness of the base portion around the gap is larger than the thickness of the remaining portion of the base portion.

In an embodiment, the wire is securely installed in the base portion by tightening a screw provided on the base portion.

DETAILED DESCRIPTION

The following detailed description is provided to gain a comprehensive understanding of the methods, apparatuses and/or systems described herein. Various changes, modifications, and equivalents of the system, apparatuses and/or methods described herein will suggest themselves to those of ordinary skill in the art. Descriptions of well-known functions and structures are omitted to enhance clarity and conciseness.

Hereinafter, an exemplary embodiment will be described with reference to accompanying drawings.

The invention is directed to an apparatus used to form a bend in a wire and form a closed loop in the wire.

Figure 1A:
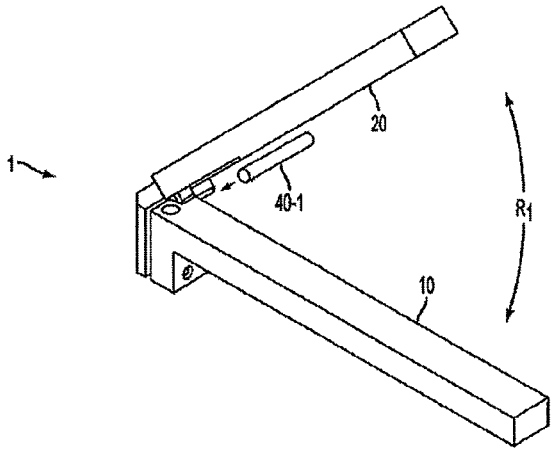
FIGS. 1A and 1B illustrate an embodiment of the wire bending structure of the present invention.
Figure 1B:
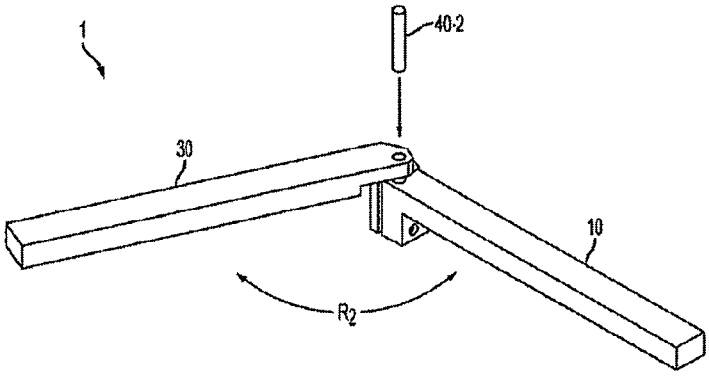

Referring to the drawings, FIGS. 1A and 1B are views of the wire bending apparatus 1 according to an embodiment of the invention. In this embodiment, the wire bending apparatus includes an anvil block 10 (i.e., a base portion) attachable to a wire bending portion 20 as shown in FIG. 1A and attachable to a loop bending portion 30 as shown in FIG. 1B. In an embodiment, the anvil block 10 is connected to the wire bending portion 20 or the loop bending portion 30 via a dowel pins 40-1 and 40-2, such that the wire bending portion is rotatable around the dowel pin 40-1 and the loop bending portion is rotatable around the dowel pin 40-2. In other embodiments, another mechanism can be used to connect the anvil block 10 to the wire bending portion 20 or the loop bending portion 30, the mechanism allowing the wire bending portion to rotate at least 90 degrees in the R1 direction (i.e., rotatable around an axis parallel to the width direction of the anvil block 10) or allows the loop bending portion to rotate at least 90 degrees in the R2 direction (i.e., rotatable around an axis perpendicular to the width direction of the anvil block 10).

Referring to the drawings, FIGS. 2A-2E are detailed views of the anvil block 10 according to an embodiment of the invention. In an embodiment, the anvil block is an "L" shaped structure having a thicker end 15 and a thinner end 16 (shown in FIG. 2E). The anvil block has a gap 11 for installing and securing a wire (W) during the wire bending operation (see FIG. 5). In an embodiment, the gap 11 is formed along the entire thickness at the thicker end 15 of the anvil block 10 and is perpendicular to the length direction of the anvil block 10 (shown in FIG. 2E). In an embodiment, the gap 11 extends about two thirds of the width of the anvil block 10. The wire may be held firm in the gap by one or more screws 14 (FIG. 2B) used for tightening the gap 11 after the wire is placed in the gap 11.

Figure 2A:
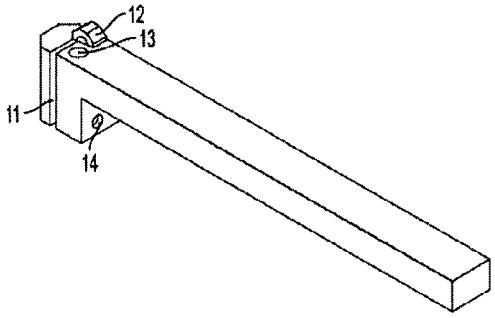
FIGS. 2A-2E illustrate different views of an anvil block according to an embodiment of the present invention.
Figure 2B:
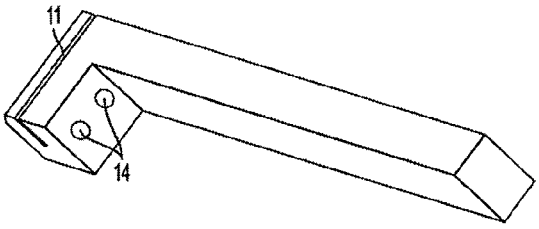
Figure 2C:
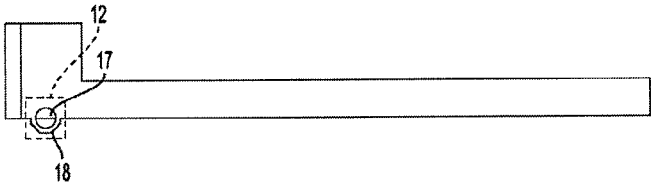

In an embodiment, the anvil block 10 has a connecting part 12 for connecting to the wire bending portion 20 and a connecting part 13 for connecting to the loop bending portion 30. As shown in FIG. 2C (anvil block 10 shown upside down), the connecting part 12 has a hole 17 that receives a dowel pin, and is formed at the thicker end of 15 of the anvil block 10. In an embodiment, the center of the hole 17 is aligned with the top edge of the anvil block 10 and an extended portion 18 is formed on the top surface of the anvil block 10 to form the hole 17 of the connecting part 12. In an embodiment, the connecting part 12 is provided on a side of the anvil block 10 that is opposite to side of the anvil block 10 that has the gap 11.

Figure 2D:
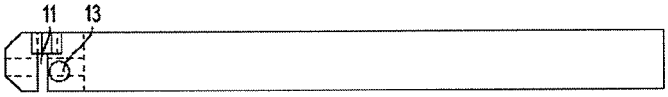
Figure 2E:
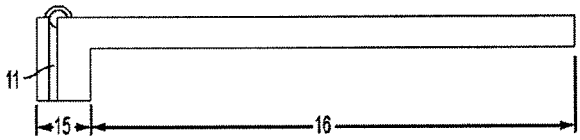

As shown in FIG. 2D, the connecting part 13 is a hole formed on the top surface of the anvil block. In an embodiment, the center of the hole of the connecting part 13 is provided nearer to the side of the anvil block that has the gap 11 at about one-thirds of the width from the side of the gap 11.

Figure 3A:
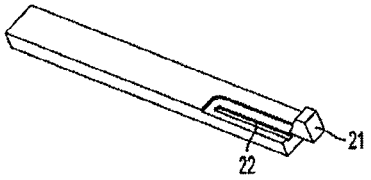
FIGS. 3A-3C illustrate different views of a wire bending portion according to an embodiment of the present invention.
Figure 3B:
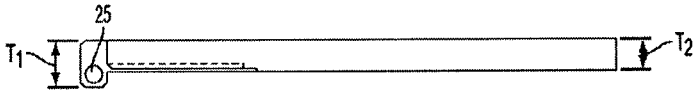
Figure 3C:
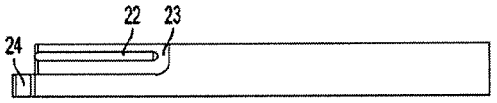

Referring to the drawings, FIGS. 3A-3C are detailed views of the wire bending portion 20 according to an embodiment of the invention. In an embodiment, the wire bending portion 20 is a rectangular (or cuboid) shaped structure having a connecting part 21 provided on one end in the length direction of the wire bending portion 20. In an embodiment, the wire bending portion has a groove 22 formed on the same end as the connecting part 21. The groove 22 is aligned with the inside edge of gap 11 of the anvil block 10 such that the wire is secure by the groove 22 during the bending operation. In an embodiment, the groove 22 assists in locating the wire for the bending operation. In an embodiment, the thickness at an area 23 around the groove 22 is smaller than the thickness at the remaining portion of the wire bending portion 20. In an embodiment, the area 23 allows the wire bending portion 20 to completely close, such that the bottom surface wire bending portion 20 is in contact with the top surface of the anvil block 10. In another embodiment, the bottom surface wire bending portion 20 may not be in full contact with the top surface of the anvil block 10.

In an embodiment, the connecting part 21 is an extended portion 24 formed on the wire bending portion 20 and has a thickness (T1) larger than the thickness (T2) of the remaining portion of the wire bending portion 20. The extended portion 24 includes a hole 25 for receiving a dowel pin. In an embodiment, the center of the hole 25 is aligned with the bottom edge of the wire bending portion 20.

Figure 6:
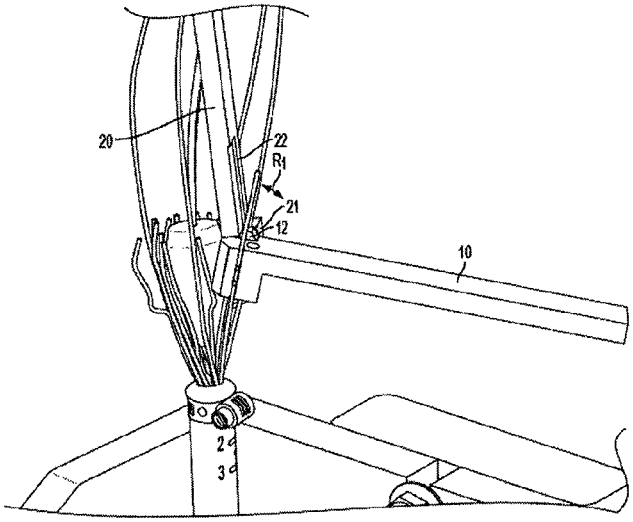
FIG. 6 illustrates a method of bending a wire using a wire bending apparatus according to an embodiment of the present invention.

Referring to the drawings, FIG. 6 shows a view of an embodiment of the invention before an operation of bending the wire. As shown in FIG. 6, the connecting part 12 of the anvil block 10 and the connecting part 21 of the wire bending portion 20 are connected through a dowel pin, such that the anvil block 10 and the wire bending portion 20 are rotatably (in R1 direction) connected with each other.

Figure 7:
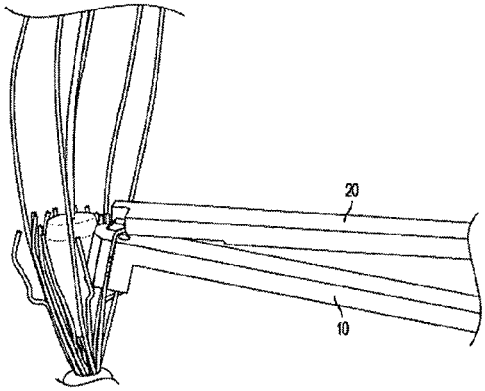
FIG. 7 illustrates a method of bending a wire using a wire bending apparatus according to an embodiment of the present invention.
Figure 8:
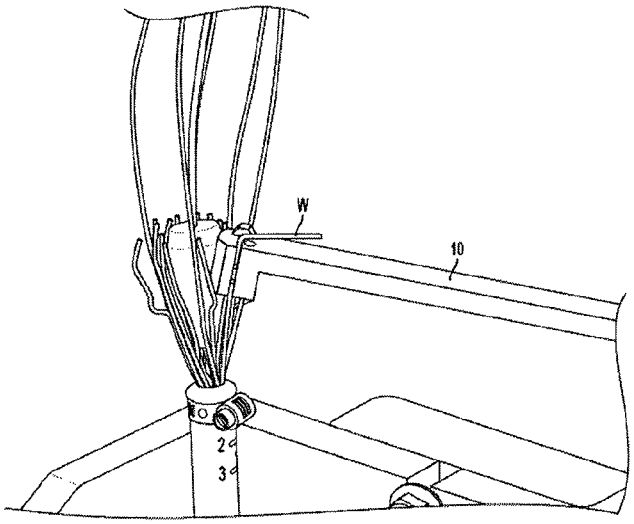
FIG. 8 illustrates a view of wire bent using a wire bending apparatus according to an embodiment of the present invention.

FIG. 7 shows a view of an embodiment of the invention after an operation of bending the wire. As shown in FIGS. 6, 7 and 8, the gap 11 of the anvil block and the groove 22 of the wire bending portion 20 are aligned with each other in such a way that the wire that is bent is provided between connecting parts 12 and 13 of the anvil block 10.

Referring to the drawings, FIGS. 4A-4E are detailed views of the loop bending portion 30 according to an embodiment of the invention. In an embodiment, the loop bending portion 30 is a generally rectangular (or cuboid) shaped structure having a connecting part 31 provided on one end in the length direction of the loop bending portion 30. In this embodiment, the connecting part 31 is a hole provided closer to one corner of the loop bending portion 30. In an embodiment, the corner opposite to the corner with the connecting part 31, in the width direction, is cut off 32. The combination of the cutoff 32 and channel 33 provide a mechanical stop for the finished loop in the wire.

Figure 4A:
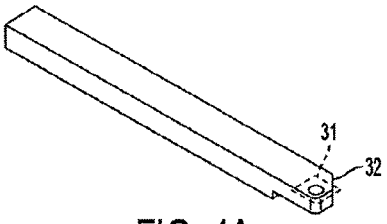
FIGS. 4A-4C illustrate different views of a loop bending portion according to an embodiment of the present invention.
Figure 4B:
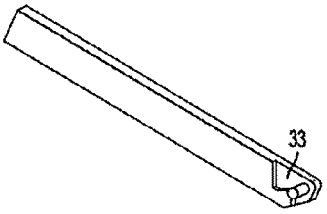
Figure 4C:
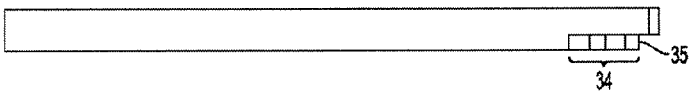

In an embodiment, as shown in FIG. 4B, there is provided a channel 33 around the connecting part 31 that has a thickness smaller than the thickness of the remaining portion of the loop bending portion 30. In an embodiment, the channel 33 is tapered 34 and has an edge 35 as shown in FIG. 4C.

Figure 9:
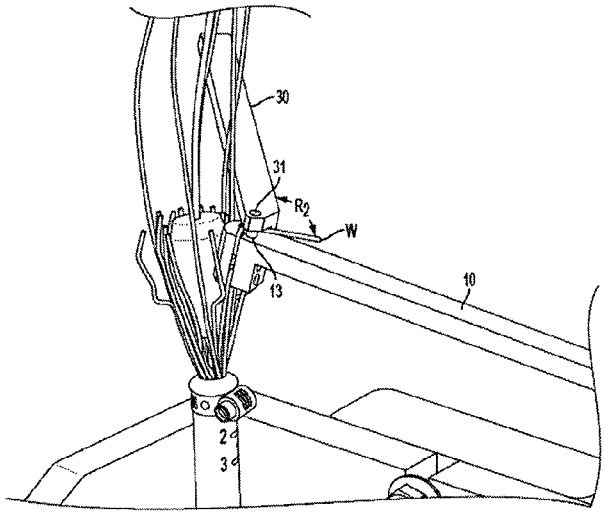
FIG. 9 illustrates a method of creating a loop in a wire using a wire bending apparatus according to an embodiment of the present invention.

Referring to the drawings, FIG. 9 shows a view of an embodiment of the invention before an operation of looping the wire. As shown in FIG. 9, the connecting part 13 of the anvil block 10 and the connecting part 31 of the loop bending portion 30 are connected through a dowel pin, such that the anvil block 10 and the loop bending portion 30 are rotatably (in R2 direction) connected with each other.

Figure 10:
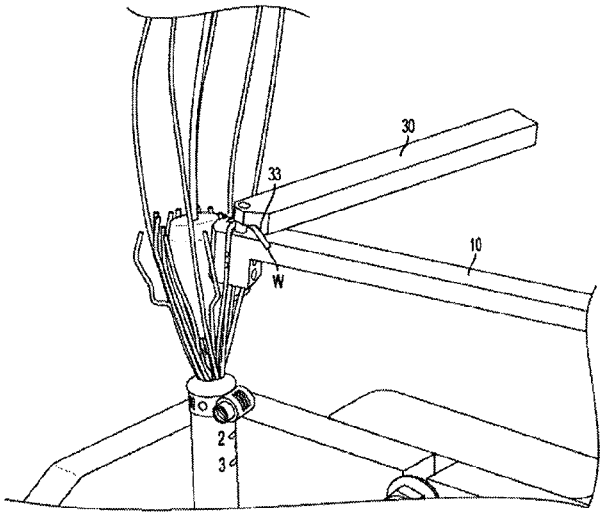
FIG. 10 illustrates a method of creating a loop in a wire using a wire bending apparatus according to an embodiment of the present invention.
Figure 11:
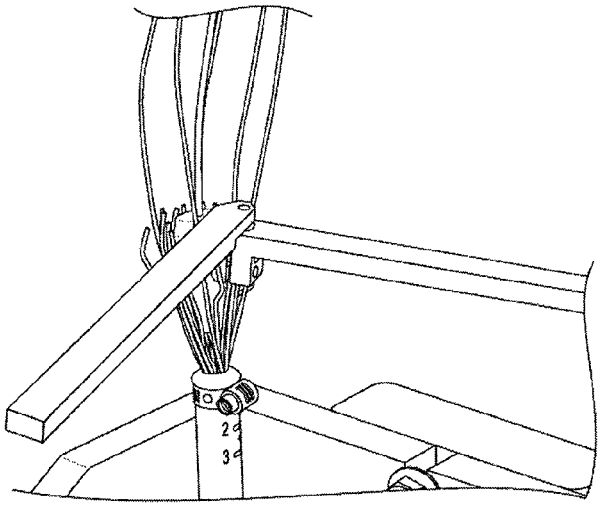
FIG. 11 illustrates a method of creating a loop in a wire using a wire bending apparatus according to an embodiment of the present invention.
Figure 12:
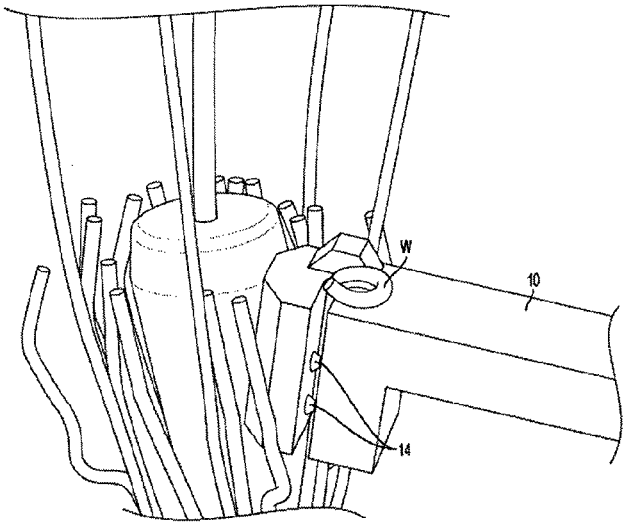
FIG. 12 illustrate a view of wire with a loop formed using a wire bending apparatus according to an embodiment of the present invention.

FIG. 10 shows a view of an embodiment of the invention during an operation of looping the wire. FIG. 11 shows a view of an embodiment of the invention after an operation of looping the wire. As shown in FIGS. 10 and 11, the wire W is provided in the channel 33 contacts the edge 35, when the loop bending portion 30 is rotated to form the loop in the wire W. In an embodiment, the edge 35 sandwiches the wire W against the extended portion 18 of the connecting part 12.

Excess wire may then be cut off using a separate wiring cutting tool. In another embodiment, the edge 35 may sandwich the wire W against a protrusion on the anvil block 10. Excess wire may then be cut off using a separate wire cutting tool.

In another embodiment, the connecting parts 12 and 13 of the anvil block 10 may be cylindrical protrusions that are received in holes provided in the wire bending portion 20 and the loop bending portion 30. In yet another embodiment, the connecting part 21 of the wire bending portion 20 may be a cylindrical protrusion that is received in a hole provided in the anvil block 10 or the connecting part 31 of the loop bending portion 20 may be a cylindrical protrusion that is received in a hole provided in the anvil block 10.

In an embodiment, the anvil block 10, the wire bending portion 20 and the loop bending portion 30 are made of metal. In one embodiment, the anvil block 10, the wire bending portion 20 and the loop bending portion 30 are made of hardened steel. In another embodiment, the anvil block 10, the wire bending portion 20 and the loop bending portion 30 can be made of other industry material.

In an embodiment, the wire bending apparatus can be used on multiple wires in a small bundle.

In an embodiment, the wire bending apparatus can be used on wires with different diameters.

In an embodiment, the wire bending apparatus can be used to create a bend on a short length of wire.

Figure 13:
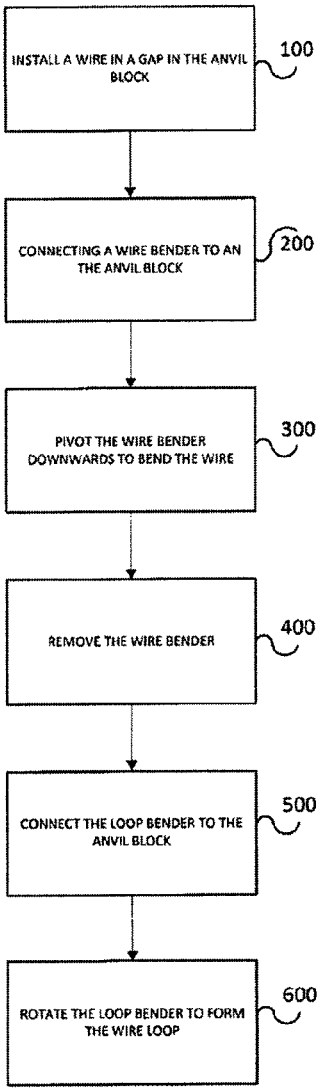
FIG. 13 illustrate a method of bending a wire using a wire bending apparatus according to an embodiment of the present invention.

Referring to the drawings, FIG. 13 illustrates a method of bending the wire and forming a loop in the bent portion of the wire.

Figure 5:
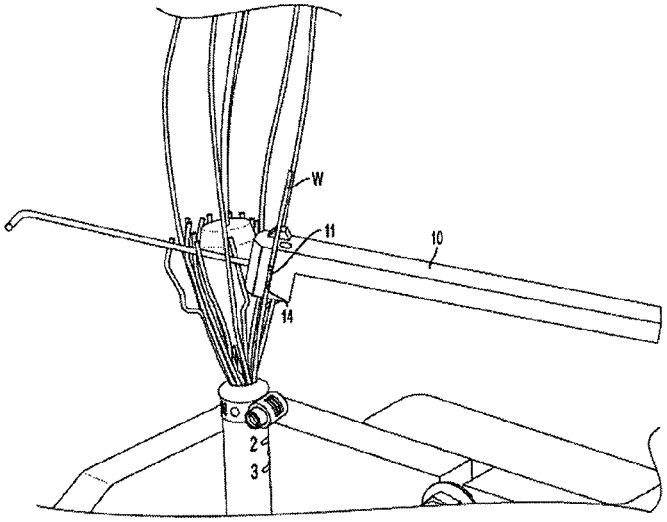
FIG. 5 illustrates a method of bending a wire using a wire bending apparatus according to an embodiment of the present invention.

At 100, a section of a wire (W) is installed in a gap 11 of the anvil block 10 (shown in FIG. 5). The wire may be soft or hard, and may be made of steel, aluminum, or copper. In an embodiment, screws 14 provided in the anvil block 10 are tightened to firmly hold the wire in the gap 11. The screws may be cone point set screws.

At 200, a wire bending portion 20 is connected to the anvil block 10 via a dowel pin (shown in FIG. 6). In an embodiment, the connecting part 12 of the anvil block 10 and the connecting part 21 of the wire bending portion 20 are connected through the dowel pin, such that the anvil block 10 and the wire bending portion 20 are rotatably (in R1 direction) connected with each other. The wire bending portion 20 is positioned so that it is parallel to the direction of the wire W secured in the anvil block 10. The wire secured in the anvil block 10 is positioned in a groove 22 in the wire bending portion 20.

At 300, the wire is bent 90 degrees by pivoting the wire bending portion 20 downwards about the dowel pin. In another embodiment, the wire bending portion 20 can be pivoted to have the wire bent between 80-100 degrees (i.e., sharp bend), or any other degree.

At 400, the wire bending portion 20 is removed, leaving a wire with a 90-degree bend installed in the anvil block 10.

At 500, the loop bending portion 30 is connected to the anvil block via a dowel pin, the connecting part 13 of the anvil block 10 and the connecting part 31 of the loop bending portion 30 are connected through a dowel pin, such that the anvil block 10 and the loop bending portion 30 are rotatably (in R2 direction) connected with each other. Also, the channel 34 in the loop bending portion engages the 90-degree bent wire.

At 600, the loop bending portion is rotated 235 degrees about the dowel pin, forming an open wire loop. After forming the loop, the loop bend fixture is removed from the wire and anvil block and the screws 14 are removed from the anvil block to release the wire.

According to an embodiment of the wire bending apparatus, a loop can be formed in a section of straight wire.

According to another embodiment of the invention, a loop and a bend between 0 and 90 degrees to the wire can be formed. According to yet another embodiment of the invention, two bends (between 30 and 70 degrees) to a wire in a short linear span can be formed. These wire bend geometries can provide improved tensile and torsional strengths to wedge-cone terminations in dead-ends and subsea terminations.

As mentioned above, the embodiments described above a are merely exemplary and the general inventive concept should not be limited thereto.

What is claimed:

1. A wire bending apparatus comprising:

a base portion having a gap perpendicular to the length direction of the base portion for anchoring a wire;

a wire bending portion connectable to the base portion for bending the wire; and a loop bending portion connectable to the base portion for creating a loop on the bent portion of the wire, wherein the base portion comprising:

a first connecting part;

a second connecting part; and a securing portion that secures the wire to the gap of the base portion, the wire bending portion comprising:

a groove provided along a length direction of the wire bending portion, in which the wire is positioned such that the wire is parallel to the wire bending portion; and a third connecting part connectable to the first connecting part, and the loop bending portion comprising:

a fourth connecting part connectable to the second connecting part, wherein the wire is rotatable around the fourth connecting part to create the loop on the bent portion of the wire; and a channel provided near the fourth connecting part for engaging the wire;

wherein an axis of rotation of the loop bending portion is different from an axis of rotation of the wire bending portion.

2. The wire bending apparatus of claim 1, wherein each of the connecting parts includes a hole for receiving a dowel pin.

3. The wire bending apparatus of claim 1, wherein one of the first connecting part and the third connecting part includes a hole, and the other of the first connecting part and the third connecting part has a protrusion that connects to the hole.

4. The wire bending apparatus of claim 1, wherein one of the second connecting part and the fourth connecting part includes a hole, and the other of the second connecting part and the fourth connecting part has a protrusion that connects to the hole.

5. The wire bending apparatus of claim 1, wherein the thickness of the base portion around the gap for anchoring the wire is larger than the thickness of the remaining portion of the base portion.

6. The wire bending apparatus of claim 1, wherein the first connecting part includes a hole provided on a side of the base portion, the third connecting part includes a hole provided on a side of the wire bending portion and a dowel pin is placed through the holes of the first and the third connecting part such that the base portion is connected to the wire bending portion.

7. The wire bending apparatus of claim 6, wherein the wire bending portion is rotatable at the axis of the third hole.

8. The wire bending apparatus of claim 1, wherein the second connecting part includes a hole provided on the top of the base portion, the fourth connecting part includes a hole provided on the bottom of the loop bending portion and a dowel pin is placed through the holes of the second and the fourth connecting part such that the base portion is connected to the loop bending portion.

9. The wire bending apparatus of claim 8, wherein the loop bending portion is rotatable at the axis of the fourth hole.

10. The wire bending apparatus of claim 1, wherein the thickness of the loop bending portion near the fourth connecting part is smaller than the thickness at the remaining portion of the loop bending portion.

11. The wire bending apparatus of claim 1, wherein the wire is secured perpendicular to the length direction of the base portion.

12. The wire bending apparatus of claim 1, wherein the securing portion includes a screw for tightening the gap to firmly hold the wire.

13. A wire bending method comprising:

installing a wire in a base portion of the wire bending apparatus;

connecting a wire bending portion to the base portion and positioning the wire bending portion to be parallel to the direction of the wire installed in the base portion;

pivoting the wire bending portion downwards towards the base portion;

disconnecting and removing the wire bending portion from the base portion;

connecting a loop bending portion to the base portion and engaging the wire in a channel in the loop bending portion; and rotating the loop bending portion to form a loop in the wire.

14. The wire bending method of claim 13, wherein the wire bending portion is connected to the base portion via a dowel pin placed into holes in the wire bending portion and the base portion.

15. The wire bending method of claim 13, wherein the wire is installed in a gap perpendicular to the length direction of the base portion.

16. The wire bending method of claim 15, wherein the thickness of the base portion around the gap is larger than the thickness of the remaining portion of the base portion.

17. The wire bending method of claim 13, wherein the wire is securely installed in the base portion by tightening a screw provided on the base portion.

18. The wire bending apparatus of claim 1, wherein the axis of rotation of the loop bending portion is perpendicular to the axis of rotation of the wire bending portion.

19. A wire bending apparatus comprising:

a base portion defining a gap for anchoring a wire, the base portion comprising a first connecting part and a second connecting part;

a wire bending portion connectable to the base portion for bending the wire, the wire bending portion comprising a groove defined along a length direction of the wire bending portion and a third connecting part connectable to the first connecting part; and a loop bending portion connectable to the base portion for creating a loop on the bent portion of the wire, the loop bending portion comprising a channel and a fourth connecting part connectable to the second connecting part, wherein an axis of rotation of the loop bending portion is different from an axis of rotation of the wire bending portion.

20. The wire bending apparatus of claim 19, wherein the thickness of the base portion around the gap for anchoring the wire is larger than the thickness of the remaining portion of the base portion.

21. The wire bending apparatus of claim 19, wherein the gap is perpendicular to a length direction of the base portion.

22. The wire bending apparatus of claim 19, wherein the axis of rotation of the loop bending portion is perpendicular to the axis of rotation of the wire bending portion.

* * * * *